US006614338B2

(12) United States Patent
Hamatani et al.

(10) Patent No.: US 6,614,338 B2
(45) Date of Patent: Sep. 2, 2003

(54) INDUCTOR AND METHOD FOR MANUFACTURING SAME

(75) Inventors: Junichi Hamatani, Shiga-ken (JP); Hisato Oshima, Takefu (JP)

(73) Assignee: Murata Manufacturing Co., Ltd., Kyoto (JP)

( * ) Notice: Subject to any disclaimer, the term of this patent is extended or adjusted under 35 U.S.C. 154(b) by 322 days.

(21) Appl. No.: 09/805,647

(22) Filed: Mar. 14, 2001

(65) Prior Publication Data

US 2001/0030595 A1 Oct. 18, 2001

(30) Foreign Application Priority Data

Mar. 14, 2000 (JP) ..... 2000-070614

(51) Int. Cl.[7] ..... H01F 5/00

(52) U.S. Cl. ..... 336/83; 336/200; 336/223; 336/192

(58) Field of Search ..... 336/83, 200, 223, 336/192, 65, 96; 29/602.1

(56) References Cited

U.S. PATENT DOCUMENTS 4,696,100 A 9/1987 Yamamoto et al.
5,692,290 A * 12/1997 Mamada et al. ..... 29/605
6,055,721 A 5/2000 Mamada et al.
6,076,253 A * 6/2000 Takayama et al. ..... 29/605
6,311,387 B1 * 11/2001 Shikama et al. ..... 29/602.1
6,375,884 B1 * 4/2002 Shikama et al. ..... 264/254
6,377,151 B1 * 4/2002 Takayama et al. ..... 336/83
6,393,691 B1 * 5/2002 Ogawa et al. ..... 29/602.1
6,560,851 B1 * 5/2003 Yamamoto et al. ..... 29/602.1
6,561,851 B2 * 5/2003 Florescu ..... 439/630

FOREIGN PATENT DOCUMENTS

| | | |
|---|---|---|
| CA | 2274165 | 12/1999 |
| EP | 0 984 465 A2 | 3/2000 |
| JP | 8-306537 | 11/1996 |

* cited by examiner

*Primary Examiner*—Ann Mai
(74) *Attorney, Agent, or Firm*—Keating & Bennett, LLP

(57) ABSTRACT

A inductor is constructed such that at least about two-thirds of a final winding of wire at each end of an internal conductor-coil embedded in a molded magnetic body project from end surfaces of the molded magnetic body by at least about one-fifth of the diameter of the wire. External electrodes are connected with respective portions of the internal conductor-coil, which are exposed at the respective end surfaces of the molded magnetic body.

8 Claims, 10 Drawing Sheets

INDUCTOR AND METHOD FOR MANUFACTURING SAME

BACKGROUND OF THE INVENTION

1. Field of the Invention

The present invention relates inductors and a method for manufacturing inductors. In particular, the present invention relates to an inductor and a method for manufacturing inductors, in which a molded magnetic body provided with a pair of external electrodes connected to an internal conductor-coil embedded in the molded magnetic body is made by molding a magnetic material which includes a powdered magnetic material and a resin.

2. Description of the Related Art

A conventional surface-mounting-type inductor 60 shown in FIG. 12 includes a coil (internal conductor-coil) 52 defining an inductance element is embedded in a molded magnetic body 53 formed by molding a magnetic material 51 including a powdered magnetic material and a resin. The molded magnetic body 53 is provided at ends thereof with a pair of external electrodes 54*a* and 54*b* connected to the coil 52 at ends 52*a* and 52*b*, respectively, of the coil 52.

The inductor 60 is manufactured, for example, such that a coil (an air-core coil) formed by densely winding an insulative covered copper wire and cutting the same by a predetermined length is provided in a mold, a magnetic molding compound made by kneading a powdered magnetic material and a resin is injected into the mold and is provided around the coil (inside and outside the coil), and the mold is released, thereby producing a molded magnetic body. The molded magnetic body is provided with external electrodes made of metallic films at ends of the molded magnetic body including exposed portions of the coil, the external electrodes are formed by coating, baking, deposition, or sputtering of a conductive paste, such that the external electrodes are connected to the exposed portions of the coil.

The inductor 60 can be manufactured only by forming the molded magnetic body 53 by molding the magnetic material 51 which is made by kneading a powdered magnetic material and a resin, and providing the external electrodes 54*a* and 54*b* made of metallic films. Therefore, a firing process at a high temperature and a baking process for the electrodes, which are necessary in manufacturing a conventional ceramic inductor including a magnetic ceramic, are not necessary, whereby manufacturing costs are reduced.

In the inductor 60, the external electrodes 54*a* and 54*b* are arranged to connect to exposed portions 52*a* and 52*b* which are portions of final windings of wire of a coil 52. The shape and the position (for example, the position in a vertical direction of the exposed portion 52*a* or 52*b*) of the exposed portion 52*a* or 52*b* of the coil 52 often differ according to each inductor 60 due to deformation of the coil 52 during injection of the magnetic material 51.

In a conventional manufacturing method, since the coil 52 is deformed due to being pressed by the mold when the length of the coil 52 is greater than that of the molded magnetic body 53, the length of the coil 52 must be substantially the same as that of the molded magnetic body 53. Therefore, as shown in FIG. 13, the exposed portion 52*a* or 52*b* of the coil 52 is formed partially in the final winding of wire of the coil 52 at the end of the molded magnetic body 53, and the area of the exposed portion 52*a* or 52*b* is reduced because of the difficulty in forming the exposed portion 52*a* or 52*b* which significantly protrudes from the end of the molded magnetic body 53.

Therefore, the connection between the coil 52 and the external electrodes 54*a* and 54*b* is not secure and an overcurrent is applied to the coil.

In another conventional inductor, the inductor 60 is provided with the external electrodes 54*a* and 54*b* which are defined by a plurality of layers such that the external electrodes 54*a* and 54*b* are easily soldered, a metallic film, such as solder, tin, or silver, to which solder easily adheres, being used as an outermost layer. When the inductor 60 is mounted on a mounting body such as a printed circuit board 61 via a method such as reflow-soldering, as shown in FIG. 14, a solder fillet 62 is raised to a height Hs which is at least ⅓ of a height H of the inductor 60 because the solder easily adheres to the external electrodes 54*a* and 54*b*. The inductor 60 is mounted such that the solder fillet 62 is electrically connected to the external electrodes 54*a* and 54*b*.

In the conventional method of manufacturing an inductor, a magnetic molding compound is injected into the mold in which a coil is not firmly affixed in a desired position in the mold. Therefore, there is a risk that the coil will move depending on the direction of flow of the magnetic molding compound during the injection process.

For example, when the inductor 60 in which the coil 52 is displaced, as shown in FIG. 15, is mounted on the printed circuit board 61, the solder fillet 62 does not reach the positions of the exposed portions 52*a* and 52*b* of the coil 52 with the external electrodes 54*a* and 54*b* therebetween even when the solder fillet 62 is raised to the height Hs which is at least ⅓ of the height H of the inductor 60, because the exposed portions 52*a* and 52*b* of the coil 52 are excessively elevated, and a gap G is produced between a lower end of the exposed portion 52*a* or 52*b* and an upper end of the solder fillet 62. The current applied to the inductor 60 flows through only the external electrodes 54*a* and 54*b* at the gap portion. Therefore, when the external electrodes 54*a* and 54*b* are made of a metallic thin film such as a solder film, long-term reliability and unsafe operation when an overcurrent is applied occur, due to insufficient current capacity in the portion having the gap.

To overcome these problems, the thickness of the metallic film defining the external electrodes 54*a* and 54*b* may be increased. However, the manufacturing costs also increase with the increased thickness of the film.

The external electrodes 54*a* and 54*b* may be formed by bonding metallic plates to the ends of the molded magnetic body 53, each of the metallic plates having a sufficient thickness required for the current capacity. However, the manufacturing costs are also increased with this method.

SUMMARY OF THE INVENTION

To overcome the above-described problems with the prior art, preferred embodiments of the present invention provide an inductor and a method for manufacturing the inductor, in which reliable connection between an internal conductor-coil and external electrodes, long-term reliability after mounted, and safety when applied with an overcurrent are achieved.

An inductor according to a preferred embodiment of the present invention includes a molded magnetic body formed by molding a magnetic material including a powdered magnetic material and a resin-based material, an internal conductor-coil embedded in the molded magnetic body such that both ends of the internal conductor-coil are exposed from both end surfaces of the molded magnetic body, respectively, and a pair of external electrodes provided at the respective end surfaces of the molded magnetic body to connect to the internal conductor-coil at the respective ends thereof. At least two thirds of a final winding of wire at each of the ends of the internal conductor-coil project from the end surface of the molded magnetic body by at least about one fifth of the diameter of the wire of the internal conductor-coil. The external electrodes are each connected with at least about two thirds of the final winding of wire at each of the ends of the internal conductor-coil, which project from the end surface of the molded magnetic body by at least about one fifth of the diameter of the wire of the internal conductor-coil.

At least about ⅔ of a final winding of wire at each end of the internal conductor-coil project from the end surface of the molded magnetic body by an amount of at least about ⅕ of the diameter of a wire, and the external electrodes are each connected with at least about ⅔ of the final winding of wire at each of the ends of the internal conductor-coil, which project from the end surface of the molded magnetic body by at least about ⅕ of the diameter of the wire of the internal conductor-coil, whereby reliable connection is established by increasing the area of connection between the internal conductor-coil and the external electrodes, and long-term reliability after mounted and safety when applied with an overcurrent are greatly improved. Moreover, the thickness of the external electrodes is greatly reduced, thereby greatly reducing the manufacturing costs.

The resin-based material used together with the powdered magnetic material, according to various preferred embodiments of the present invention, includes various materials, such as an epoxy resin, a synthetic resin including polyphenylene sulfide, and a rubber resin including a chloroprene rubber or a silicone rubber.

The external electrodes are preferably defined by a plurality of layers of metallic films.

When each external electrode is defined by a plurality of layers, an inductor having reliable electrical connection and solderability is provided by depositing a tin-plating film or a solder-plating film on a base metallic film defining the external electrodes.

The center of the final winding of wire at each of the ends of the internal conductor-coil is spaced away from the center of each end surface of the molded magnetic body by a distance not greater than about half of the inner diameter of the internal conductor-coil.

Since the center of the final winding of wire at each of the ends of the internal conductor-coil is spaced away from the center of each end surface of the molded magnetic body by a distance not greater than about ½ of the inner diameter of the internal conductor-coil, the condition described below is efficiently prevented from occurring. That is, when an inductor in which an internal conductor-coil is displaced is mounted on a printed circuit board, a solder fillet does not reach a position where the solder fillet is opposed to an exposed portion of the coil with external electrodes therebetween because the position of the exposed portion of the internal conductor-coil is excessively elevated, and a gap is produced between a lower end of the exposed portion and an upper end of the solder fillet. Therefore, when the external electrodes are made of a metallic thin film such as a plating film, reliability and safety are substantially diminished when an overcurrent is applied, due to insufficient current capacity in the portion corresponding to the gap. These problems are prevented by preferred embodiments of the present invention.

According to another preferred embodiment of the present invention, a method for manufacturing an inductor includes the steps of preparing the internal conductor-coil, setting the internal conductor-coil in a mold, coupling the internal conductor-coil with a coil-supporting member at an inner periphery of the internal conductor-coil for supporting the internal conductor-coil at the inner periphery thereof, thereby preventing the internal conductor-coil from being deformed and maintaining the internal conductor-coil in a position and shape in which the internal conductor-coil is disposed to be exposed from a magnetic material at ends of the internal conductor-coil, and a first injection step of injecting the magnetic material through a gate provided at a predetermined position of the mold into a region of the mold except for a region at the inner periphery of the internal conductor-coil in which the coil-supporting member is disposed, removing the coil-supporting member after the magnetic material injected in the first injection step cures, and a second injection step of injecting the magnetic material into the region at the inner periphery of the internal conductor-coil through another gate provided at a predetermined position of the mold, thereby forming a molded magnetic body in which a major portion of the internal conductor-coil is embedded in the molded magnetic body and at least about two thirds of a final winding of wire at each end of the internal conductor-coil project from an end surface of the molded magnetic body by at least about one fifth of the diameter of the wire of the internal conductor-coil, and forming a pair of external electrodes at the respective end surfaces of the molded magnetic body so that the external electrodes are each connected with at least about two thirds of the final winding of wire at each of the ends of the internal conductor-coil, which project from the end surface of the molded magnetic body by at least about one fifth of the diameter of the wire of the internal conductor-coil.

The internal conductor-coil is supported by the coil-supporting member at the inner periphery of the internal conductor-coil so as to prevent the internal conductor-coil from being deformed and to maintain the internal conductor-coil in a position and a shape in which the internal conductor-coil is disposed so as to be exposed from a magnetic material at ends of the internal conductor-coil, the magnetic material is injected into a region of the mold except for a region at the inner periphery of the internal conductor-coil, the coil-supporting member is removed after the magnetic material cures, and the magnetic material is injected into the region at the inner periphery of the internal conductor-coil, thereby forming a molded magnetic body in which at least about ⅔ of a final winding of wire at each end of the internal conductor-coil project from an end face of the molded magnetic body by at least about ⅕ of the diameter of a wire of the internal conductor-coil. A pair of external electrodes are provided at the respective end surfaces of the molded magnetic body such that the external electrodes are each connected with at least about ⅔ of the final winding of wire at each of the ends of the internal conductor-coil, which project from the end surface of the molded magnetic body by at least about ⅕ of the diameter of the wire of the internal conductor-coil. Thus, the inductor according to preferred embodiments of the present invention is efficiently and reliably manufactured.

The mold is provided with substantially annular concave portions, each of the annular concave portions is provided at an inner surface of the mold opposing the end of the internal conductor-coil such that at least one portion of the final winding of wire at the end of the internal conductor-coil is fitted with the annular concave portion.

By using the mold which is provided with substantially annular concave portions, each of the annular concave portions at an inner surface of the mold opposing the end of the internal conductor-coil and at least one portion of the final winding of wire at the end of the internal conductor-coil is fitted with the annular concave portion, a molded magnetic body, in which at least about ⅔ of a final winding of wire at each end of the internal conductor-coil project from an end surface of the molded magnetic body by at least about ⅕ of the diameter of the wire of the internal conductor-coil, is reliably produced.

The center of each substantially annular concave portion provided at the inner surface of the mold and the center of each end surface of the molded magnetic body substantially correspond to each other.

When the centers of each substantially annular concave portion provided at the inner surface of the mold and each end surface of the molded magnetic body substantially coincide with each other, a risk of a phenomena described below is efficiently avoided. That is, when an inductor in which an internal conductor-coil is displaced is mounted on a printed circuit board, a solder fillet does not reach a position where the solder fillet is opposed to an exposed portion of the coil with external electrodes therebetween because the position of the exposed portion of the internal conductor-coil is excessively elevated, and a gap is produced between a lower end of the exposed portion and an upper end of the solder fillet. Therefore, when the external electrodes are made of a metallic thin film such as a plating film, long-term reliability and safety is substantially diminished when an overcurrent is applied, due to insufficient current capacity in the portion corresponding to the gap. These problems are prevented by the preferred embodiments of the present invention.

Other features, elements, characteristics and advantages of the present invention will become apparent from the detailed description of preferred embodiments thereof with reference to the attached drawings.

DETAILED DESCRIPTION OF PREFERRED EMBODIMENTS

Preferred embodiments according to the present invention are described in detail.

Figure 1:
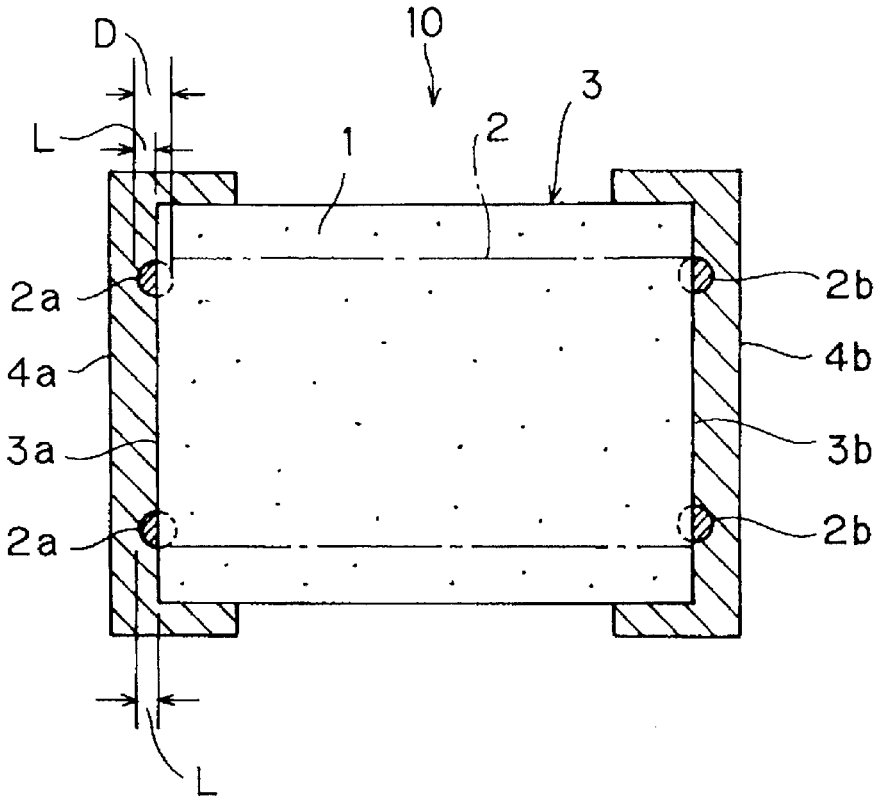
FIG. 1 is a sectional view of an inductor according to a preferred embodiment of the present invention.
Figure 2:
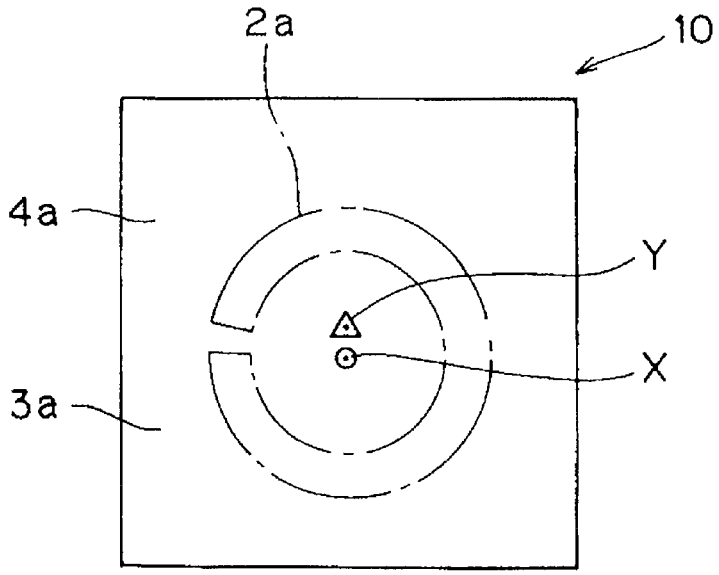
FIG. 2 is a side view of the inductor according to the preferred embodiment of the present invention shown in FIG. 1.
Figures 3A, 3B:
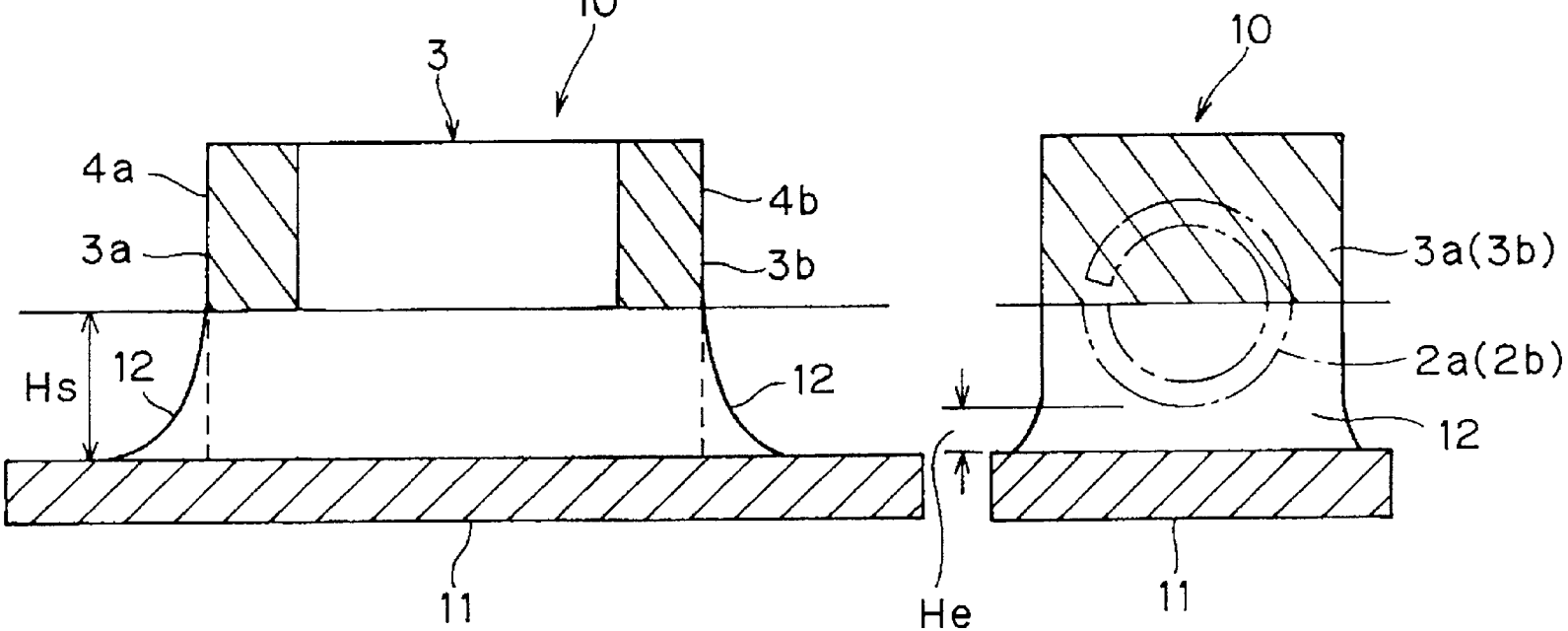
FIGS. 3A and 3B are schematic plan view and side view, respectively, of the mounted inductor according to a preferred embodiment of the present invention.

FIG. 1 is a sectional view of an inductor according to a preferred embodiment of the present invention. FIG. 2 is a side view of the inductor.

An inductor 10 according to the present preferred embodiment shown in FIGS. 1 and 2 preferably includes a molded magnetic body (magnetic core) 3 formed by molding a magnetic material 1 including a powdered magnetic material and a resin kneaded with each other in a desired shape, an internal conductor-coil 2, defining an inductance element, embedded in the molded magnetic body 3 and exposed at ends 2*a* and 2*b* of the internal conductor-coil 2 from end surfaces 3*a* and 3*b* of the molded magnetic body 3, and a pair of external electrodes 4*a* and 4*b* provided at the end surfaces 3*a* and 3*b*, respectively, of the molded magnetic body 3 connected to the internal conductor-coil 2 at the ends 2*a* and 2*b* thereof, respectively. The dimensions of the inductor 10 are, for example, approximately 4.5 mm×3.2 mm×3.2 mm.

The molded magnetic body (magnetic core) 3 is preferably made of a ferrite resin which is formed by kneading a PPS (polyphenylene sulfide) resin and a powdered ferrite including iron oxide ($Fe_2O_3$), nickel oxide (NiO), copper oxide (CuO), and zinc oxide (ZnO).

The internal conductor-coil 2 is formed by winding a copper wire having a diameter of, for example, about 0.2 mm, and has a length of, for example, about 3.2 mm and an inner diameter of, for example, about 1.8 mm.

In the inductor 10 shown in FIG. 1, a significant portion of a final winding of wire at each end of the internal conductor-coil 2 is exposed, and a major portion of each of the ends (exposed portion) 2*a* and 2*b* projects along the axis of the internal conductor-coil 2 such that a projection amount L from the end surface 3*a* or 3*b* of the molded magnetic body 3 is at least about ⅕ of diameter D of the wire.

The external electrodes 4*a* and 4*b* extend from the end surfaces 3*a* and 3*b* of the molded magnetic body 3 to peripheral surfaces (side surfaces) thereof and connected to the exposed portions 2*a* and 2*b* of the internal conductor-coil 2. The external electrodes 4*a* and 4*b* are each preferably defined by a plurality of layers including a nickel-plating film electrically connected to the internal conductor-coil 2 and a tin-plating film which is provided on the nickel-plating film to improve solderability.

The inductor 10 is arranged so that a center X of a final winding of wire at each end of the internal conductor-coil 2 is positioned away from a center Y of each end surface 3*a* or 3*b* of the molded magnetic body 3 by a distance not greater than about ½ of the inner diameter of the internal conductor-coil 2 (see FIG. 2). That is, the amount of offset of the center X of the final winding of wire at each end of the internal conductor-coil 2 is not greater than about ½ of the inner diameter of the internal conductor-coil 2 from the center Y of each end surface 3*a* or 3*b* of the molded magnetic body 3.

In the inductor 10 thus formed, a significant portion (at least about ⅔ windings) of the final winding of wire at each end of the inductor coil 2 projects substantially in the axial direction of the internal conductor-coil 2 from the end surface 3*a* or 3*b* of the molded magnetic body 3 by at least about ⅕ of the diameter of the wire, and the external electrodes 4*a* and 4*b* are disposed to be connected to the exposed portions 2*a* and 2*b* at the ends of the internal conductor-coil 2. Therefore, contact areas between the internal conductor-coil 2 and the respective external electrodes 4*a* and 4*b* are greatly increased, and electrical current is reliably applied to the connection portion between the external electrodes 4*a* and 4*b* and the internal conductor-coil 2, whereby the long-term reliability after mounted and the safety when an overcurrent is applied is ensured.

Since the center X of the final winding of wire at each end of the internal conductor-coil 2 of the inductor 10 is positioned at a distance not greater than about ½ of the inner diameter of the internal conductor-coil 2 from the center Y of the end surface 3*a* or 3*b* of the molded magnetic body 3, a solder fillet 12 is raised to a position corresponding to the exposed portion 2*a* (2*b*) of the internal conductor-coil 2 via the external electrode 4*a* (4*b*), that is, a height (position) Hs of the upper end of the solder fillet 12 is greater (higher) than a height (position) He of the lower end of the exposed portion 2*a* (2*b*) of the internal conductor-coil 2. Therefore, a gap between the lower end of the exposed portion 2*a* (2*b*) of the internal conductor-coil 2 and the upper end of the solder fillet 12 is not produced. Even when the external electrodes 4*a* and 4*b* are made with a metallic thin film such as a plated film, the long-term reliability is ensured by maintaining current capacity of these portions and the safety when an overcurrent is applied is efficiently maintained.

Figure 4:
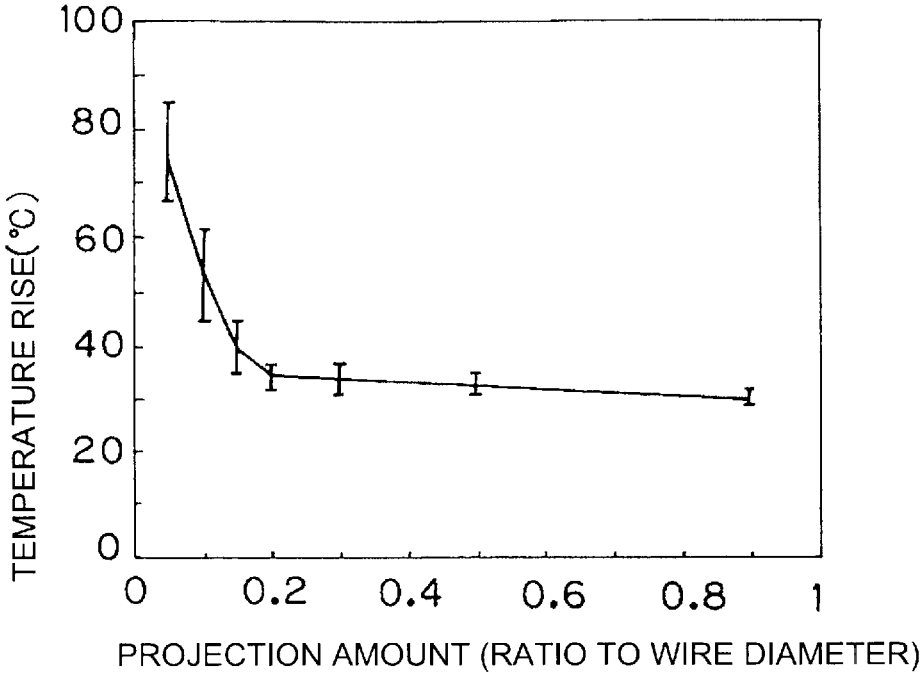
FIG. 4 is a graph showing the relationship between the projection amount of an internal conductor-coil (ratio to the diameter of a wire) and the temperature rise in a connection portion of external electrodes and the internal conductor-coil.

FIG. 4 is a graph showing the relationship between projection amount of the internal conductor-coil 2 (ratio to the diameter of the wire) from the end surface 3*a* or 3*b* of the molded magnetic body 3 and temperature rise in the connected portions between the external electrodes 4*a* and 4*b* and the internal conductor-coil 2, when an electrical current of 2 amperes is applied.

FIG. 4 shows that the temperature rise in the connected portions is greatly suppressed when the projection amount (ratio to the diameter of the wire) of the internal conductor-coil 2 from the end surface 3*a* or 3*b* of the molded magnetic body 3 is at least about ⅕ (approximately 0.04 mm) of the diameter D (approximately 0.2 mm) of the wire.

Generally, an inductor including a coil wire having a large diameter has a large rated current. Particularly, the temperature rise in the connected portions is suppressed by setting the projection amount (ratio to the diameter of the coil wire) of the internal conductor-coil 2 from the end surface 3*a* or 3*b* of the molded magnetic body 3 to at least about ⅕ of the diameter D of the wire, thereby greatly improving reliability.

Figure 5:
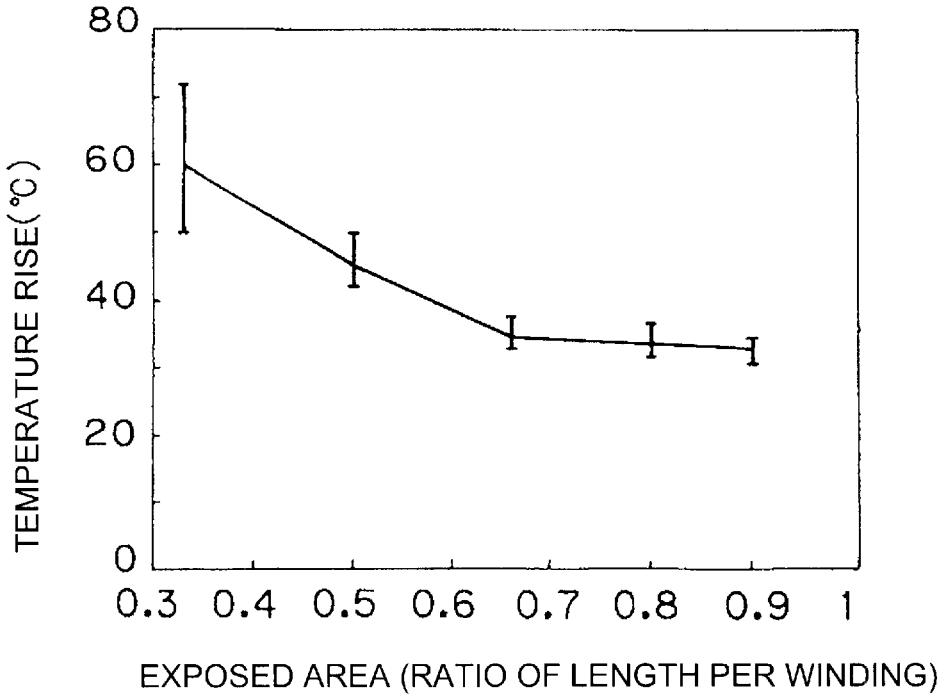
FIG. 5 is a graph showing the relationship between the area of exposed portions of the internal conductor-coil (ratio of the length of the exposed portions of the internal conductor-coil to a winding of wire) and the temperature rise in the connection part of the external electrodes and the internal conductor-coil.

FIG. 5 is a graph showing the relationship between the ratio of the exposed portion per winding of wire of the internal conductor-coil 2 (the ratio of the length of the exposed portions 2*a* and 2*b* of the internal conductor-coil 2 to that of the final windings at the ends thereof (for example, the ratio is about 0.75 when the length of the exposed portions is about ¾ of the length of the final windings)) and the temperature rise in the connected portions of the external electrodes 4*a* and 4*b* with the internal conductor-coil 2.

As shown in the graph shown in FIG. 5, the temperature rise in the connected portions between the respective external electrodes 4*a* and 4*b* and the internal conductor-coil 2 can be suppressed by setting the ratio of the exposed portion per winding of the internal conductor-coil 2 so as to be not smaller than about 0.66 (⅔ windings).

Figure 6:
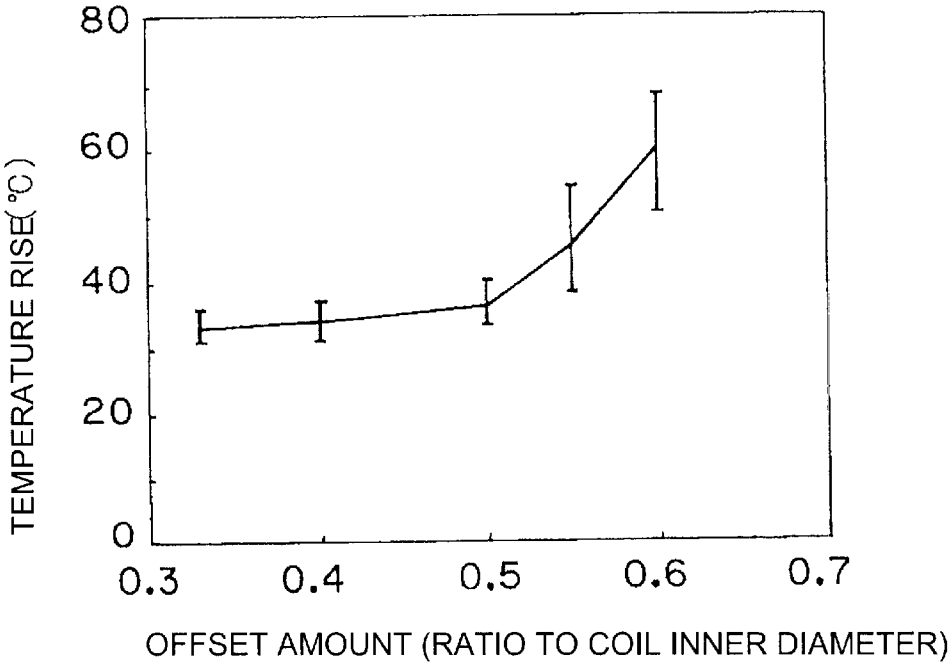
FIG. 6 is a graph showing the relationship between the amount of offset of the internal conductor-coil (ratio to the inner diameter of the internal conductor-coil) and the temperature rise in the external electrodes.

FIG. 6 is a graph showing the relationship between the amount of offset of the center X of the internal conductor-coil 2 from the center Y of the end surface 3*a* or 3*b* of the molded magnetic body 3 (the ratio of the offset distance to the inner diameter of the internal conductor-coil 2 (ratio to the inner diameter of the coil)) and the temperature rise in the external electrodes 4*a* and 4*b*.

As shown in FIG. 6, the temperature rise in the external electrodes 4*a* and 4*b* is efficiently suppressed by setting the amount of offset (the ratio to the inner diameter of the coil) to a value not greater than about ½ (0.9 mm) of the inner diameter of the internal conductor-coil 2.

When a gap is produced between the lower end of the exposed portion 2*a* (2*b*) of the internal conductor-coil 2 and the upper end of the solder fillet 12, applied current flows only through the external electrodes 4*a* and 4*b* at the gap portion thereof, whereby the temperature rise in the gap portion of the external electrodes 4*a* and 4*b* substantially increases.

A method for manufacturing the above inductor is described below.

Figure 7:
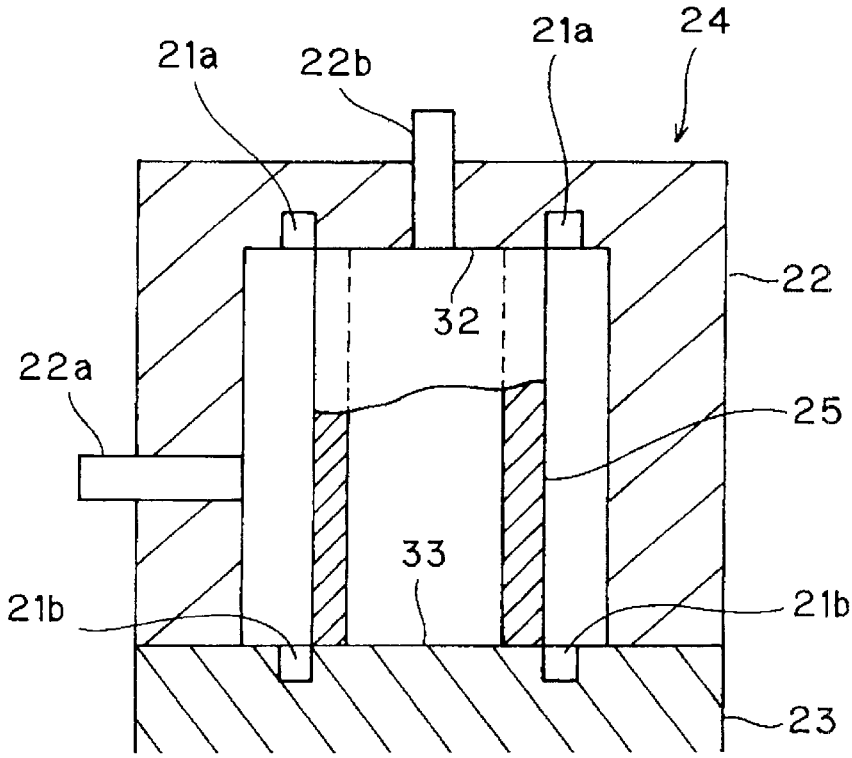
FIG. 7 is a sectional view of a mold to be used in a method for manufacturing an inductor, according to another preferred embodiment of the present invention.
Figure 8:
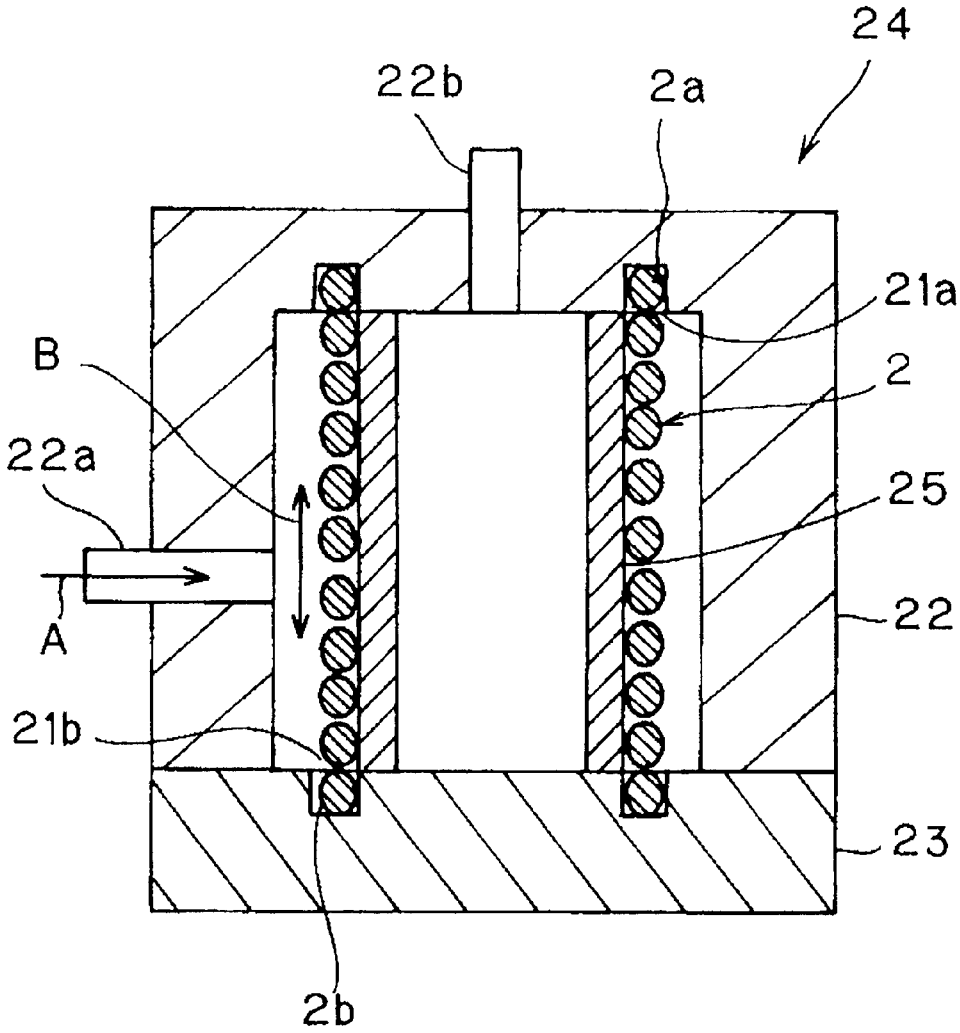
FIG. 8 is a sectional view of the mold in which the internal conductor-coil is set in a process of the method for manufacturing an inductor, according to a preferred embodiment of the present invention.

(1) As shown in FIGS. 7 and 8, to manufacture the above inductor, a mold 24 is prepared, the mold 24 including an upper mold 22 provided with a substantially annular concave portion 21*a* provided in the upper mold 22 at an inner surface thereof opposing an end of the internal conductor-coil 2 to receive at least one portion of a final winding of wire at the end of the internal conductor-coil 2, and a lower mold 23 provided with a substantially annular concave portion 21*b* provided in the lower mold 23 at the inner surface thereof opposing the other end of the internal conductor-coil 2 so as to receive at least one portion of the final winding of wire at the other end of the internal conductor-coil 2. Each of the substantially annular concave portions 21*a* and 21*b* has a width of about 0.3 mm and a depth of about 0.2 mm. However, the shape and the size of the substantially annular concave portions 21*a* and 21*b* are not limited to those described above, and they may be any shape and size as long as the internal conductor-coil 2 insulated by a coating material is received and affixed in the concave portions 21*a* and 21*b*.

The mold 24 prevents deformation of the internal conductor-coil 2 (see FIG. 8), and is configured such that a substantially cylindrical coil-supporting member (protection pin) 25 for supporting and affixing the internal conductor-coil 2 inside the mold 24 at a center thereof can be mounted in the mold 24. The coil-supporting member 25 is mounted substantially at a central portion of the mold 24 such that the coil-supporting member 25 is placed on the lower mold 23, and the upper mold 22 covers the lower mold 23 holding the coil-supporting member 25.

Figure 9:
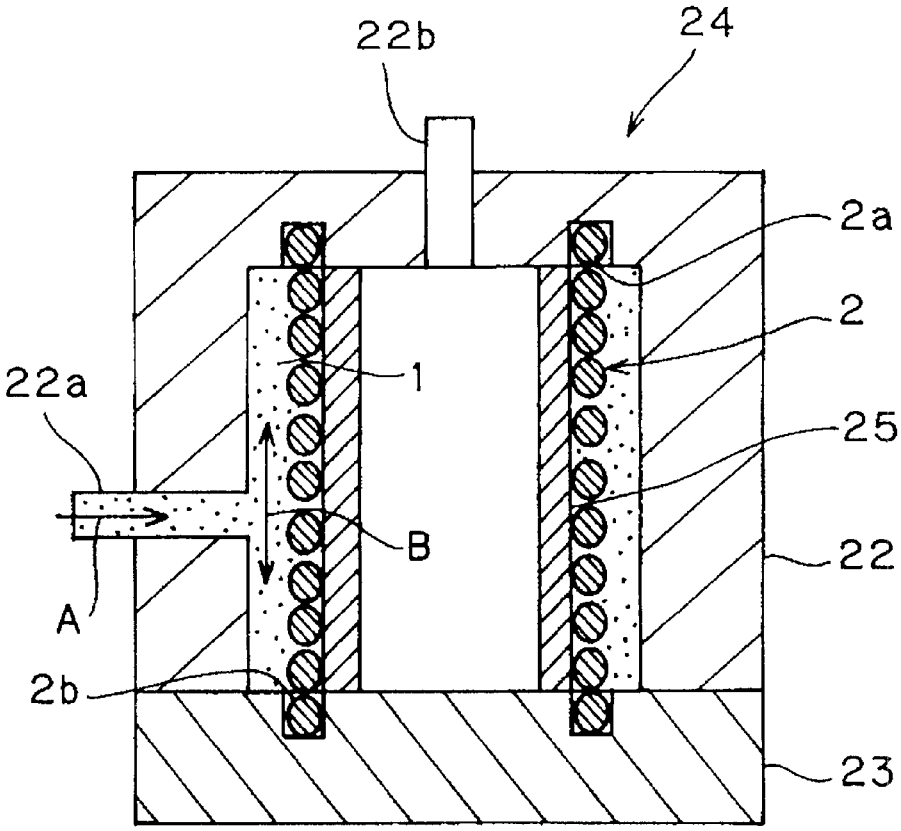
FIG. 9 is a sectional view showing a first step of injection of the method for manufacturing an inductor, according to a preferred embodiment of the present invention.
Figure 11:
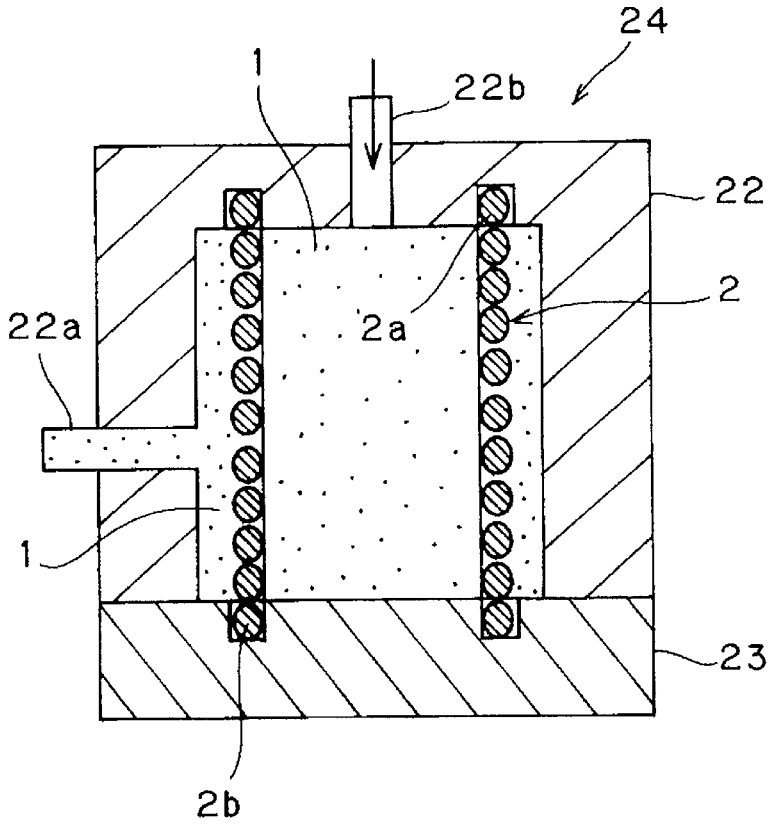
FIG. 11 is sectional view showing a second step of injection of the method for manufacturing an inductor, according to a preferred embodiment of the present invention.
Figure 12:
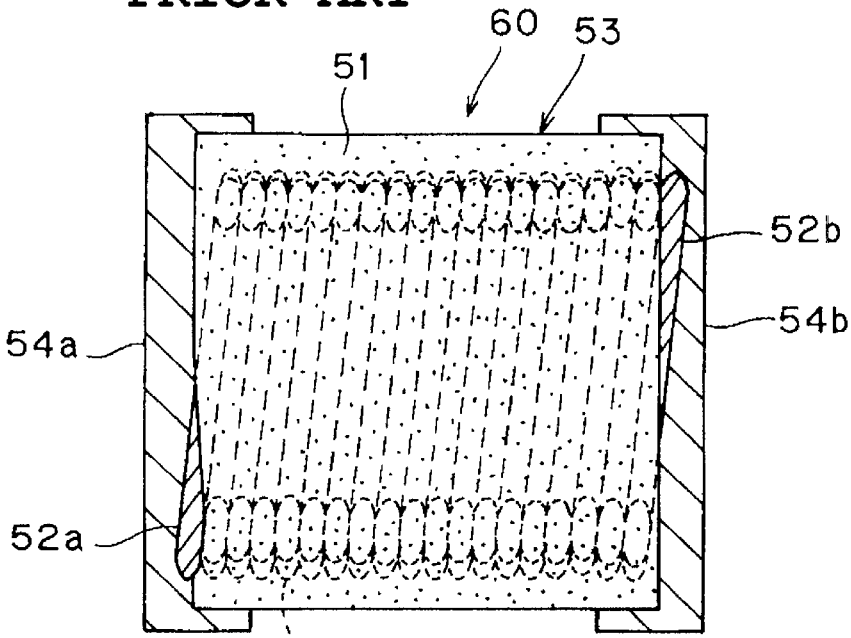
FIG.12 PRIOR ART
FIG. 12 is a sectional view of a conventional inductor.
Figure 13:
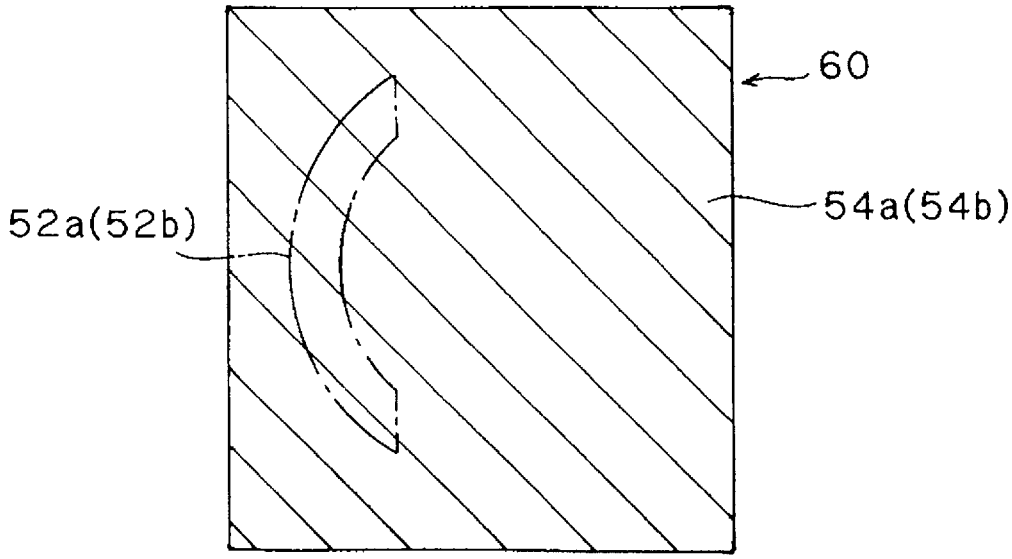
FIG.13 PRIOR ART
FIG. 13 is a side view of the conventional inductor.
Figure 14:
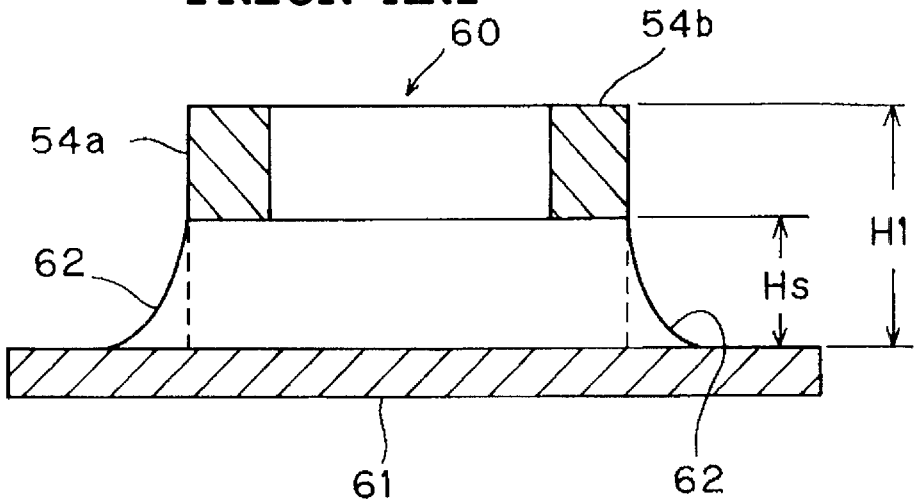
FIG.14 PRIOR ART
FIG. 14 is a front view of the mounted conventional inductor.
Figure 15:
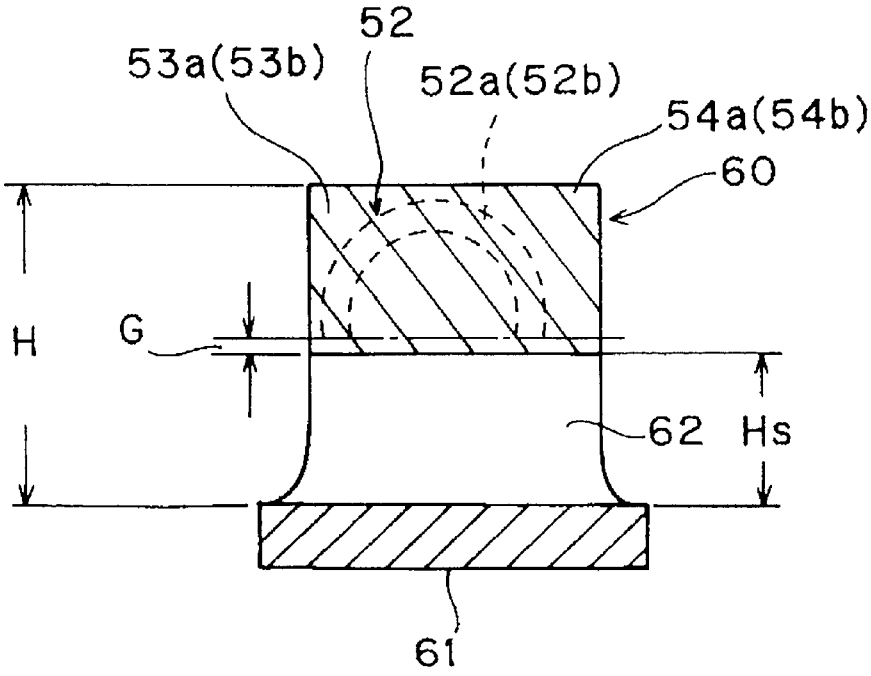
FIG.15 PRIOR ART
FIG. 15 is a side view of the mounted conventional inductor.

The upper mold 22 is provided with gates 22*a* and 22*b* at a side and an upper portion, respectively, of the upper mold 22, through which the magnetic material 1 is injected into the mold 24 (see FIGS. 9 and 11).

The mold 24 is configured such that centers of the above annular concave portions 21*a* and 21*b* are positioned substantially at centers of an inner lower surface 32 of the upper mold 22 and an inner upper surface 33 of the lower mold 23, respectively.

(2) After the coil-supporting member 25 positioned in the lower mold 23, the internal conductor-coil 2 is fitted into the coil-supporting member 25, and the upper mold 22 is positioned on the lower mold 23 holding the coil-supporting member 25 and the internal conductor-coil 2, whereby the internal conductor-coil 2 is supported in a desired position in the mold 24, as shown in FIG. 8, such that it is not deformed.

(3) As shown in FIG. 9, the magnetic material 1, which is formed by melting a pellet-formed ferrite resin made by kneading a PPS (polyphenylene sulfide) resin and a powdered ferrite including iron oxide ($Fe_2O_3$), nickel oxide (NiO), copper oxide (CuO), and zinc oxide (ZnO), is injected (a first injection) via the gate 22*a* provided at the side of the upper mold 22 into a region in the mold 24 except for the inside of the internal conductor-coil 2 (a region occupied by the coil-supporting member 25).

Figure 10:
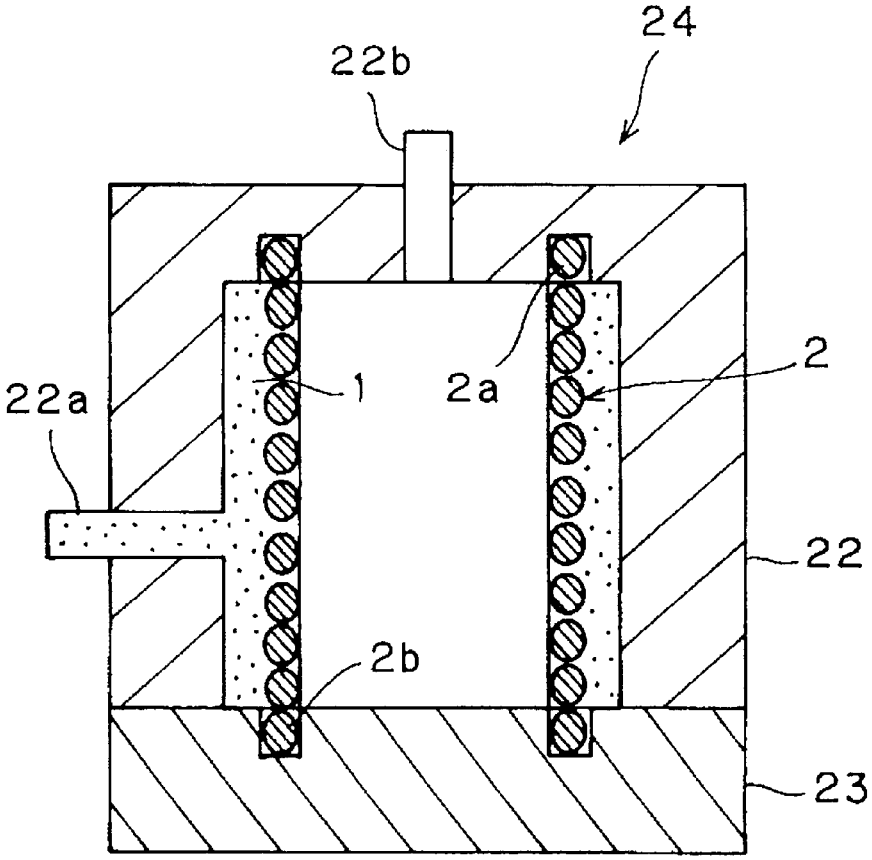
FIG. 10 is a sectional view of the mold from which a coil-supporting member has been removed after the first step of injection of the method for manufacturing an inductor, according to a preferred embodiment of the present invention.

(4) The coil-supporting member 25 is removed from the mold 24, as shown in FIG. 10.

(5) The magnetic material 1 is injected (a second injection) via the gate 22*b* provided at the upper surface of the upper mold 22 into the inside of the internal conductor-coil 2, whereby the molded magnetic body (a ferrite-resin-molded body including a coil) 3 having dimensions of, for example, approximately 4.5×3.2×3.2 (mm) is obtained.

In this case, the temperature in the mold 24 is set at 160° C., and the temperature of a cylinder for supplying the magnetic material 1 is set at 340° C.

(6) The molded magnetic body 3 thus obtained is rinsed with pure water, is well rinsed with alcohol, is deoxidized by applying palladium solution, and the overall molded magnetic body 3 is coated with a nickel film, which has a thickness of about 1 μm to about 2 μm, formed by electroless nickel-plating.

(7) A resist film having a thickness of approximately 10 μm is printed in a portion to be provided with the external electrodes 4*a* and 4*b* at the ends of the molded magnetic body 3, and is dried at about 150° C. for 10 about minutes. The molded magnetic body 3 printed with the resist film is dipped for several minutes in a solution of nitric acid of 30%, thereby removing by etching the nickel film formed by electroless nickel-plating from a portion other than the portion corresponding to the external electrodes 4*a* and 4*b*.

(8) The resist film is removed by dipping the molded magnetic body 3 in a solution of sodium hydroxide of about 3% while supersonic vibration is applied to the molded magnetic body 3.

(9) The molded magnetic body 3 provided with a nickel film formed by electroless nickel-plating at the ends of the molded magnetic body 3 is provided with another nickel film having a thickness of about 1 μm to about 2 μm formed by electrolytic nickel-plating performed in a barrel, the molded magnetic body 3 being overlaid with the electrolytic nickel film on the electroless nickel-plating film. The molded magnetic body 3 is further provided with a tin-film having a thickness of about 3 μm to about 5 μm formed by electrolytic tin-plating on the electrolytic nickel-plating film, whereby the surface-mounting-type inductor 10 shown in FIG. 1 is obtained.

In the above manufacturing method, the first injection of the magnetic material 1 is performed via the gate 22*a* provided at the side of the upper mold 22. In FIG. 9, although the magnetic material 1 flows horizontally (along an arrow A), the internal conductor-coil 2 is not deformed toward the inside because the internal conductor-coil 2 is supported and affixed by the coil-supporting member 25. Consequently, the internal conductor-coil 2 is supported while being applied with pressure toward the ends thereof (in directions B (a vertical direction)), and is fixed to the mold 24 in a manner such that the ends 2*a* and 2*b* of the internal conductor-coil 2 engage with the substantially annular concave portions 21*a* and 21*b*, respectively, which are provided in positions at which the ends 2*a* and 2*b* of the internal conductor-coil 2 come into contact, respectively, with the mold 24.

When the second injection of the magnetic material 1 is performed, the molded magnetic body 3 has ends of the internal conductor-coil 2, each having approximately one winding length, exposed at the end surfaces 3*a* and 3*b*, respectively, of the molded magnetic body 3, and the projection amount L of the internal conductor-coil 2 from each of the end surfaces 3*a* and 3*b* of the molded magnetic body 3 is at least about ⅓ of the diameter D of the wire of the internal conductor-coil 2. As a result, inductor having highly reliable connectivity is produced, which has a large area of connected portions between the external electrodes 4*a* and 4*b* and the internal conductor-coil 2, as shown in FIG. 1.

In FIG. 2, the respective centers X of the annular concave portions 21*a* and 21*b* substantially coincide with the centers Y of the lower surface 32 of the upper mold 22 and the upper surface of the lower mold 33, respectively, whereby the molded magnetic body 3 is produced in which the centers X of the final winding portions of the internal conductor-coil 2 substantially coincide with the centers Y of the end surfaces 3*a* and 3*b*, respectively, of the molded magnetic body 3, as shown in FIG. 1.

Therefore, a risk of phenomena described below is efficiently avoided. That is, when an inductor in which a coil is displaced is mounted on a printed circuit board or other suitable component, a solder fillet does not extend to an exposed portion of the coil with external electrodes therebetween because the exposed portion of the coil is excessively elevated, and a gap is produced between a lower end of the exposed portion and an upper end of the solder fillet. Therefore, when the external electrodes are made of a metallic thin film such as a solder film, the long-term reliability is reduced and safety when an overcurrent is applied is reduced, due to insufficient current capacity in the portions corresponding to the gap.

The ratio of an exposed portion in a final winding of wire of an internal conductor-coil at each end of a molded magnetic body (the ratio of the exposed portion in a final winding of the internal conductor-coil of which the projection amount is at least about ⅓ of the diameter of the wire of the internal conductor-coil) and the amount of offset of the center of the final winding of the internal conductor-coil from the center of each end surface of the molded magnetic body were measured for 1000 inductors (samples) manufactured by the method described above, and the result is shown in table 1.

TABLE 1

| Items | Criteria | Conventional Inductors | Inductors according to the invention |
|---|---|---|---|
| Ratio of exposed portion per final winding of internal coil (projected by at least about ⅕ of wire diameter) | ⅔ or more | 0.1% | 100% |
| | ½ or more | 3% | 100% |
| | ⅓ or more | 10% | 100% |
| Amount of offset of internal coil (ratio to inner diameter of coil) | ¼ or less | 0.5% | 100% |
| | ⅓ or less | 43% | 100% |
| | ½ or less | 78% | 100% |

In table 1, the ratio of an exposed portion in a final winding of wire of an internal conductor-coil at each end of a molded magnetic body (the ratio of the exposed portion in the final winding of wire of the internal conductor-coil of which the projection amount is at least about ⅕ of the diameter of the wire of the internal conductor-coil) and the amount of offset of the center of the final winding of the internal conductor-coil from the center of each end face of the molded magnetic body are also shown, which were measured for 1000 inductors manufactured by a conventional method.

In table 1, the proportion of the samples (inductors), which met with the criteria, to 1000 samples are shown.

It is seen from table 1 that the ratio of the inductors manufactured by the conventional method, of which at least about ⅔ of a final winding of wire project by an amount of at least about ⅕ of the wire, is only 0.1%, and the ratio of the inductors, which have the same criteria, manufactured by the method according to the present preferred embodiment is 100%. Therefore, according to preferred embodiments of the present invention, long-term reliability and safety when applied with an overcurrent are greatly improved by increasing the area of connection between the internal conductor-coil and the external electrodes.

It is also seen from table 1 that the ratio of the inductors manufactured by the conventional method, which have the offset amount of the center of a final winding of wire of the internal conductor-coil from the center of each end surface of the molded magnetic body of not greater than about ½ of the inner diameter of the internal conductor coil, is only 78%, and that the offset amount, when manufactured by the method according to the preferred embodiments of the present invention, is reduced to be not greater than about ¼ of the inner diameter of the internal conductor-coil.

The present invention is not limited to the above-described preferred embodiment, and it is intended to include various arrangements and modifications, within the spirit and scope of the present invention, regarding the type of the magnetic molding compound, the particular shape of the molded magnetic body, the material for the internal conductor-coil, the material for the baked external electrodes, and other features of the present invention.

While preferred embodiments of the invention have been disclosed, various modes of carrying out the principles disclosed herein are contemplated as being within the scope of the following claims. Therefore, it is understood that the scope of the invention is not to be limited except as otherwise set forth in the claims.

What is claimed is:

1. An inductor comprising:

a molded magnetic body including a molded magnetic material member including a powdered magnetic material and a resin-based material;

an internal conductor-coil embedded in the molded magnetic body such that both ends of the internal conductor-coil are exposed from both end surfaces of the molded magnetic body, respectively; and a pair of external electrodes provided at the respective end surfaces of the molded magnetic body to be connected to the internal conductor-coil at the respective ends thereof; wherein at least about two thirds of a final winding of wire at the respective ends of the internal conductor-coil project from the end surface of the molded magnetic body by at least about one fifth of the diameter of the wire of the internal conductor-coil; and the external electrodes are each connected with at least about two thirds of the final winding of wire at the respective ends of the internal conductor-coil, which project from the end surface of the molded magnetic body by at least about one fifth of the diameter of the wire of the internal conductor-coil.

2. An inductor according to claim 1, wherein the center of the final winding of wire at the respective ends of the internal conductor-coil is spaced away from the center of each end surface of the molded magnetic body by a distance not greater than about half of the inner diameter of the internal conductor-coil.

3. An inductor according to claim 1, wherein the external electrodes are each defined by a plurality of layers of metallic films.

4. An inductor according to claim 3, wherein the center of the final winding of wire at the respective ends of the internal conductor-coil is spaced away from the center of each end surface of the molded magnetic body by a distance not greater than about half of the inner diameter of the internal conductor-coil.

5. An inductor according to claim 1, wherein said molded magnetic body is made of a ferrite resin.

6. An inductor according to claim 5, wherein said ferrite resin includes a polyphenylene sulfite resin and a powdered ferrite including iron oxide, nickel oxide, copper oxide and zinc oxide.

7. An inductor according to claim 1, wherein said internal conductor-coil is defined by a copper wire.

8. An inductor according to claim 7, wherein said copper wire defining said internal conductor-coil has an outer diameter of about 0.2 mm, a length of about 3.2 mm, and an inner diameter of about 1.8 mm.

* * * * *